United States Patent [19]

Edwards

[11] 4,053,092

[45] Oct. 11, 1977

[54] DISENGAGEABLE ROLL POSITIONING APPARATUS

[76] Inventor: Arthur Wayne Edwards, Rte. No. 2, Box 257A, Mechanicsville, Va. 23111

[21] Appl. No.: 661,321

[22] Filed: Feb. 25, 1976

[51] Int. Cl.[2] ..... B65H 17/22

[52] U.S. Cl. ..... 226/90; 226/181

[58] Field of Search ..... 226/90, 91, 176, 177, 226/181, 89

[56] References Cited

U.S. PATENT DOCUMENTS

| | | | |
|---|---|---|---|
| 3,438,423 | 4/1969 | Melull | 226/90 X |
| 3,884,407 | 5/1975 | Sugimizu | 226/90 |

*Primary Examiner*—Richard A. Schacher

*Attorney, Agent, or Firm*—Norman B. Rainer

[57] ABSTRACT

An apparatus is provided for the rapid engagement and disengagement of a passive roll with a drive roll. The apparatus comprises a locking lever mechanism which positions a self-aligning roll-holding yoke assembly in a manner such as to form a precise nip line between the passive roll and drive roll.

2 Claims, 3 Drawing Figures

DISENGAGEABLE ROLL POSITIONING APPARATUS

BACKGROUND OF THE INVENTION

In apparatus for the handling of continuous lengths of flexible films, such as packaging equipment which advances film from a spool to its point of use, cylindrical rolls are utilized to advance the film without wrinkling or other distortions in the film being handled. Such roll mechanisms usually consist of a drive or power roll, and a driven or passive roll which rests upon the drive roll and is rotated either by frictional engagement with the drive roll or by the enmeshing of gears located on the ends of the roll axles. The film passes through the line of contact between the two rolls, known as the "nip", and is thereby held firmly for uniform propulsion toward its point of use.

To ensure that the film is uniformly gripped in its passage through the nip of the rolls, the surfaces of the rolls must be perfectly mated at the nip line. This requires not only a high degree of perfection in the cylindrical surfaces of the rolls, but also requires precise juxtaposition of the rolls so that the nip line is unbroken and perfectly perpendicular to the direction of film travel. The difficulties in achieving a perfect nip line are particularly accentuated when the films are very thin (e.g. four mils or less) and have widths greater than five inches.

In most film advancing equipment, it is preferable to utilize passive rolls which can be quickly and easily removed from engagement with the drive roll. The purpose of this is to facilitate string-up or threading of the film through the equipment, and to simplify clean-out of the equipment in the event of malfunctions where film may pile up or jam in the rolls. Such desirable feature of adjustability of the passive roll for quick engagement or disengagement with the drive roll further accentuates the difficulties in achieving a precision nip, particularly after repeated cycles of engagement and disengagement.

Disengageable passive roll assemblies have generally been equipped with spring or counterweight mechanisms to place the roll under a tension forcing it into contact with the drive roll. In the course of long term use, however, spring tension diminishes in an unpredictable manner, causing unreliable performance. Another problem encountered with spring-urges and counterweighted rolls is that a chatter may occur wherein the resilient nature of the restoring force permits a slight bouncing of the roll over surface blemishes in either the rolls or the film.

SUMMARY OF THE INVENTION

In accordance with the present invention, a disengageable roll positioning apparatus is provided which applies uniform tension to a passive roll without the use of a resilient restoring force, and which forms a precise nip line with an associated drive roll.

The apparatus of the present invention applies a positioning and tensioning force to a passive roll by means of a locking lever mechanism and an interacting self-aligning roll-holding yoke assembly. The lever mechanism is capable of rapid engagement and disengagement, and provides a consistent tensioning and positioning of the passive roll. The locking lever mechanism is comprised of three interacting members movable by virtue of three pivot points, said interacting members communicating between an adjustable anchor base and a pivoted roll-holding yoke assembly. In its forward position, the lever mechanism positions and locks the pivoted roll-holding yoke assembly so as to cause the passive roll mounted within the yoke to be in accurate and firm contact with the drive roll. In its rearward position, the lever mechanism swings the passive roll away from the drive roll, permitting easy access to both rolls for re-threading, cleaning, or other sevicing operations. The forward and rearward motion of the locking lever mechanism can be effectuated either manually or automatically.

To establish a precise nip line, the apparatus of this invention provides a special yoke assembly comprised of two substantially identical bearing arms joined in opposed relationship by a holding means such as a tie bar. The bearing arms accomodate the axle of a passive roll intended for engagement with a drive roll. Each bearing arm is attached to the tie bar in a manner such as to permit a controlled small amount of independent pivoting movement about the tie bar in a plane perpendicular to the rotational axis of the passive roll. The tie bar is connected to the aforementioned locking lever mechanism.

The combined and concerted action of the locking lever mechanism and the self-aligning yoke assembly is such as to provide the sought precision and reliability of engagement of a passive roll with a drive roll.

BRIEF DESCRIPTION OF THE DRAWINGS

In the accompanying drawings

DETAILED DESCRIPTION OF THE INVENTION

Figure 1:
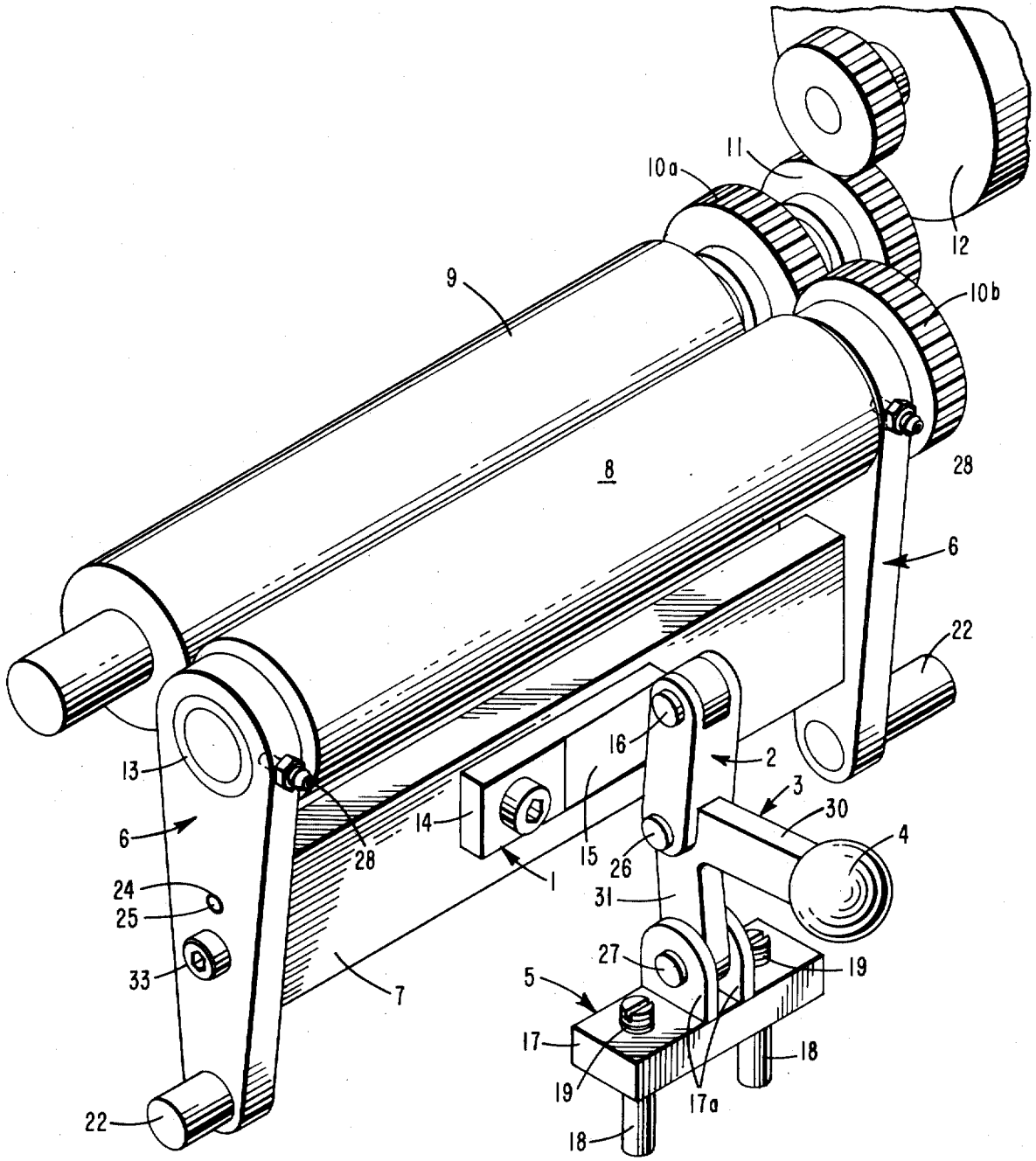
FIG. 1 is a perspective view of a preferred disengageable roll positioning apparatus of the present invention illustrating a locking lever mechanism and a self-aligning roll-holding yoke assembly, shown in association with a drive roll and drive means not a part of this invention.

Referring to the accompanying drawings, FIG. 1 illustrates a disengageable roll positioning apparatus of the present invention comprising a self-aligning yoke assembly in co-operative association with a locking lever mechanism.

The yoke assembly consists of a pair of generally flat elongated bearing arms 6 held in opposed relationship by a holding means such as tie bar 7. Each bearing arm contains at one extremity thereof a bearing ring 13; and at the opposite extremity a pivoting means such as a circular hole adapted for rotatable engagement with stub shaft 22 connected to frame member 21 shown in FIGS. 2 and 3. Alternatively, the pivoting means may consist of a stub shaft mounted within the lower extremity of the bearing arm, and adapted for engagement with a hole in frame member 21. Still other pivoting means may be employed. In the embodiment shown in the drawings, the yoke assembly is positioned in a manner such that the bearing ring is in the uppermost extremity of the arm. However, in other modes of utilization, the apparatus may be positioned such that the bearing arms extend downward, horizontally or at intermediate angles of inclination.

The bearing arms are held in an aligned relationship such that the centers of bearing rings 13 fall on a line which constitutes the rotational axis of a cylindrical passive roll 8 which may be operatively mounted within said bearing rings. Each bearing arm contains lubricating means such as oiling nipple 28 and an internal passageway communicating with the bearing ring.

The passive roll 8 may be of conventional design having a smooth continuous surface or a segmented and/or contoured surface fabricated of metal or resilient material. The passive roll operatively engages with the film 34 being driven by drive roll 9, shown in FIG. 3. The drive roll may be operated by suitable conventional drive means such as a motor 12 which transmits its power through a coupling means such as gear 11 to enmeshing gears 10*a* and 10*b* attached to the drive roll 9 and passive role 8 respectively. The gears 10*a* and 10*b* provide an accurate registering of the relative motion of the rolls. Other means may however be utilized to transmit a motivating force from the drive roll to the passive roll.

Figure 2:
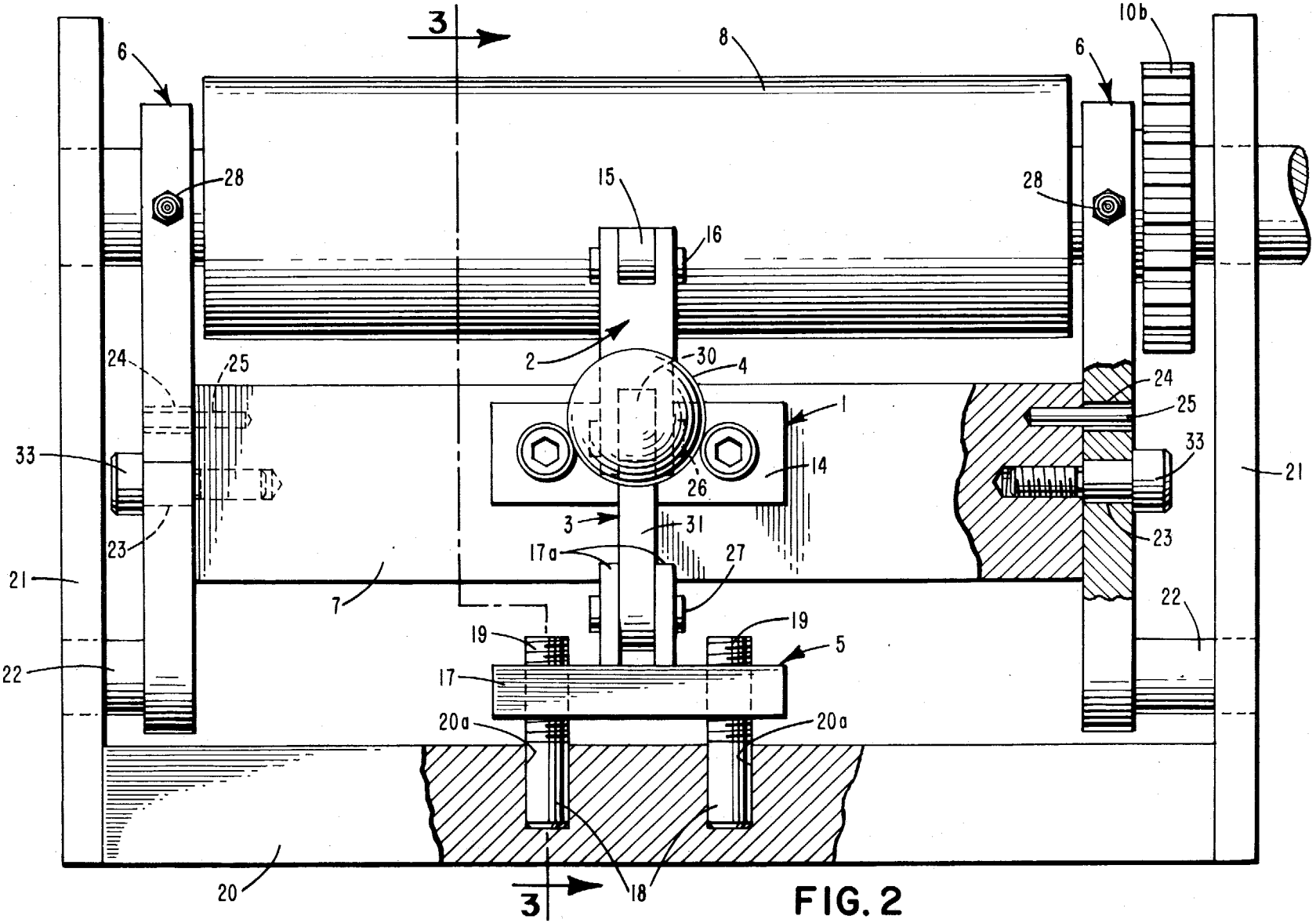
FIG. 2 is a front elevational view, partially in section, of the apparatus of FIG. 1 including means 20 and 21 for positioning the apparatus on associated equipment.

Each bearing arm 6 contains, below the bearing ring 13, a cylindrically bored hole 23, shown in FIG. 2, having its center axis perpendicular to the bearing arm and coaxial with the axis of the bearing ring, and being designed to accomodate the cylindrical bearing portion of shoulder screw 33. The threaded lower portion of shoulder screw 33 engages with a threaded hole in tie bar 7. Hole 23 may contain a countersunk region so that the head of the shoulder screw will fit flush with the external surface of the bearing arm. In such embodiment, the shoulder screw is provided with a hexagonal recess in its head to accomodate an Allen wrench.

The function of shoulder screw 33 is to mount the bearing arm 6 to tie bar 7 in a manner such that the bearing arm will be able to move pivotably with respect to the tie bar in a plane essentially perpendicular to the rotational axes of rolls 8 and 9. The extent of permissible movement of the bearing arm is controlled by a limiting means consisting of a dowel 25 protruding from the tie bar 7 and adapted to extend into a hole 24 in bearing arm 6 located between hole 23 and bearing ring 13. The hole 24 has a diameter about 0.005 inches larger than the diameter of dowel 25.

Because of this, the bearing arm has a controlled small amount of pivoting motion with respect to the associated tie bar 7. This controlled movement, in conjunction with the action of the locking lever mechanism, enables the passive roll to find a perfect alignment with the drive roll. The extent of permissible movement will generally range from about 0.01 inches to 0.001 inches.

Figure 3:
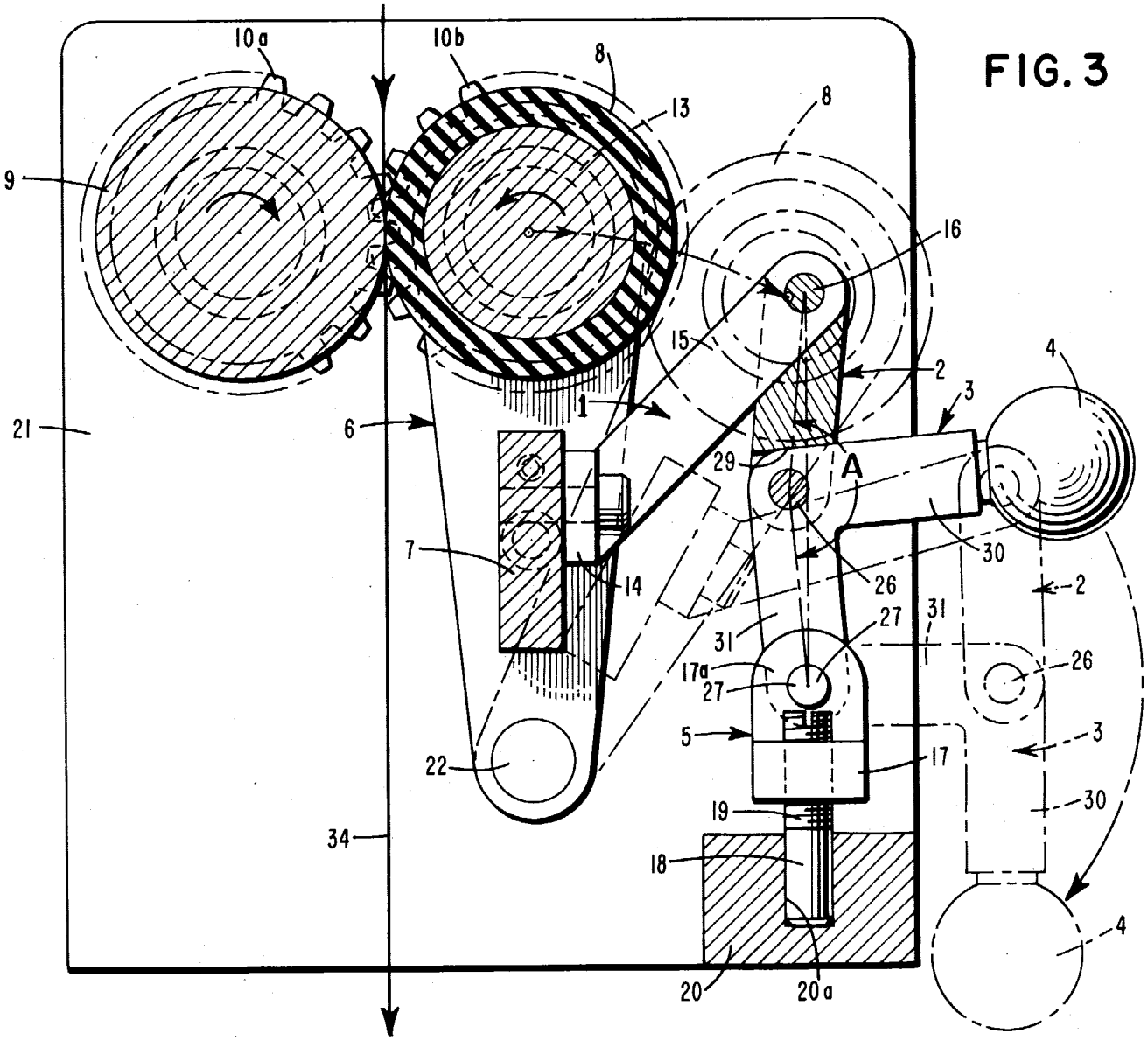
FIG. 3 is a sectional view of the apparatus of FIG. 2, taken along the line 3—3 of FIG. 2, and showing the roll positioning apparatus in both forward and rearward positions.

The locking lever mechanism, as shown in FIGS. 1 and 3 consists essentially of four basic parts, namely: yoke anchor 1, moving clevis 2, lever 3, and adjustable base anchor 5. The yoke anchor 1 consists of a mounting base 14 secured to tie bar 7, and upwardly extending arm 15. The mounting base 14 is provided with holes to accomodate screws for mounting to the tie bar 7 of the yoke assembly. At the uppermost extremity of arm 15 there is a circular hole to accomodate upper pivot pin 16. The angle of the arm 15 with respect to the mounting base 14, and the length of said arm are carefully chosen so as to determine the critical location of upper pivot pin 16. The location of said pin, as more clearly shown in FIG. 3, is above tie bar 7, preferably at a height close to the axis of passive roll 8, and close to vertical alignment with lower pivot pin 27 of adjustable anchor 5 when the locking lever mechanism is in the forward, locked position.

The pivot pin 16 housed in the uppermost extremity of upwardly extending arm 15 of the yoke anchor engages with the upper end of a moving clevis 2. Said moving clevis is preferably a short straight link designed to accomodate a pivot pin at each extremity. The function of the moving clevis is to translate force and position from the lever mounted on its lower extremity, to the yoke anchor connected to its upper extremity. A positioning shoulder 29, shown in FIG. 3, is cut inside the clevis. Its purpose is to serve as an abutting means to limit the forward travel of the lever 3 toward the drie roll.

The lever 3 shown in the drawings is formed with two arms, 30, 31 at right angles to one another, a pivot pin 26 at their vertex, which pin engages with the lower end of moving clevis 2. Likewise, the lower end of the lever 3 engages with the adjustable base anchor 5 by means of lower pivot pin 27, as shown in FIG. 1. The arm 30 of lever 3 may optionally be provided with a positioning knob 4 as shown in FIG. 1. The function of the knob is to provide a convenient site for an operator to manually grasp the lever and apply a force in a direction either toward the drive roll or away from it. Other equivalent means can however be provided to permit the application of pushing or pulling force to the upper extremity of arm 31 of the lever. For example, a simple hole might be provided in the upper portion of arm 31 to permit the use of a quickly insertable, separate knob handle, or automatic mechanical contrivance to facilitate application of the necessary pulling or pushing force. Such expedient would obviate the need for the arm 30 and knob 4.

The adjustable base anchor 5 shown in the drawings is designed to have a substantially flat base portion 17, which may be provided with holes for mounting purposes, and upright tabs 17*a* drilled to accomodate lower pivot pin 27 which engages with the lower end of the lever 3. For accurate and adjustable positioning of the base anchor, the preferred embodiment of the invention utilizes two adjusting screws 19 which can control the height and angle of the base portion 17 with respect to any support surface it is mounted on. The adjusting screws 19 may consist of a threaded upper portion which engages with a threaded hole in base portion 17, and a smooth cylindrical lower portion 18 which functions merely as a peg, and fits within a smooth bore hole 20*a* in a support member 20.

When the locking lever mechanism is in the forward, locked position, shown in FIG. 3 and thereby engaging the passive roll with the drive roll for controlled advancement of a film 34, the middle pivot pin 26, namely the pin connecting the moving clevis to the lever, is closer to the yoke assembly than either of the other two pivot pins. If a line is drawn between the centers of upper pivot pin 16 and lower pivot pin 27, the location of the center of the middle pivot pin 26, when in the locked position, defines the apex of an obtuse triangle pointed in the direction of the yoke assembly. The obtuse angle, labeled A in FIG. 3 will, in preferred embodiments, range from 130° to 175°.

Having thus described my invention, I claim:

1. A roll positioning apparatus for urging a passive roll into engagement with a drive roll comprising a self-aligning yoke assembly cooperatively joined to a locking lever mchanism comprised of three interacting members pivotably connected at three sites and communicating between an adjustable anchor base and said yoke assembly, said three interacting members comprising: (1) a yoke anchor attached at one extremity to said yoke assembly and attached by means of an upper pivot pin at its opposite extremity to (2) a moving clevis which is attached by means of a middle pivot pin at its opposite extremity to (3) a lever which at its opposite extremity is attached by means of a lower pivot pin to an adjustable anchor base.

2. Apparatus of claim 1 wherein said three interacting members are operatively associated with an abutting means which stops the forward travel of the locking lever mechanism in a manner such that said middle pivot pin is positioned closer to said yoke assembly than either said upper or lower pivot pins, and the obtuse angle formed by the centers of said three pivot pins, having the apex at the center of said middle pivot pin, has a value between 130° and 175°.

* * * * *